US005217357A

United States Patent [19]

Welch

[11] Patent Number: 5,217,357

[45] Date of Patent: Jun. 8, 1993

[54] ROTARY VANE PUMP WITH REMOVABLE PARTICULATE COLLECTION CHAMBER

[76] Inventor: Robert E. Welch, 7 Hamlin La., Wilmington, Mass. 01887

[21] Appl. No.: 942,768

[22] Filed: Sep. 10, 1992

[51] Int. Cl.[5] ..... F04B 23/10; F04C 2/344

[52] U.S. Cl. ..... 418/46; 417/204; 417/313; 418/186

[58] Field of Search ..... 417/204, 313; 418/DIG. 1, 186, 187, 276, 46

[56] References Cited

U.S. PATENT DOCUMENTS

| | | | |
|---|---|---|---|
| 661,067 | 11/1900 | Nash | 418/46 |
| 1,104,070 | 7/1914 | Overly . | |
| 2,504,841 | 4/1950 | Jones | 417/204 |
| 2,658,456 | 11/1953 | Wahlmark | 418/46 |
| 3,145,662 | 8/1964 | Eickmann . | |
| 3,256,831 | 6/1966 | Eickmann | 418/186 |
| 3,478,887 | 11/1969 | Ohrberg | 418/46 |
| 3,932,063 | 1/1976 | Butler . | |
| 4,578,948 | 4/1986 | Hutson et al. . | |
| 4,808,067 | 2/1989 | Saulgeot | 415/90 |
| 5,173,041 | 12/1992 | Niimura | 418/46 |

FOREIGN PATENT DOCUMENTS

| | | | |
|---|---|---|---|
| 2744591 | 4/1979 | Fed. Rep. of Germany | 417/204 |
| 405776 | 2/1943 | Italy | 418/186 |
| 70982 | 5/1982 | Japan | 418/186 |
| 26388 | 2/1987 | Japan | 418/46 |
| 894202 | 7/1949 | Netherlands | 418/186 |
| 362758 | 12/1931 | United Kingdom | 418/186 |

*Primary Examiner*—Richard A. Bertsch
*Assistant Examiner*—Roland McAndrews
*Attorney, Agent, or Firm*—Richard C. Litman

[57] ABSTRACT

A rotary vane pump has a hollow rotor and a stationary liquid distributor member within the hollow rotor center, within which member plural supply and discharge fluid paths are provided. An elliptical housing allows for any one pumping chamber defined between adjacent slidable vanes to undergo plural pumping cycles. The novel pump is suited to operate under conditions of low inlet pressure and high discharge pressure, and is usable with incompressible liquids. The elliptical housing is formed by a boundary ring located within a pump casing, the boundary ring having an elliptical inner surface and a cylindrical outer surface. The pump may selectively include structure for enabling separation of particulate material from pumped liquids by the use of centrifugal force. The particulate material enters an opening in the boundary ring, the opening being connected by a passageway in the pump casing to a removable particulate collection chamber connected to the pump casing.

1 Claim, 4 Drawing Sheets

ROTARY VANE PUMP WITH REMOVABLE PARTICULATE COLLECTION CHAMBER

BACKGROUND OF THE INVENTION

1. Field Of The Invention

The present invention relates to an expansible chamber rotary vane pump.

2. Description Of The Related Prior Art

U.S. Pat. No. 1,104,070, issued to Charles F. Overly on Jul. 21, 1914, discloses a rotary vane machine having fluid feed from the center of the rotor, radial passages within the rotor communicating between the rotor center and the compression chambers formed between vanes, and an elliptical housing cavity providing two expansion and contraction cycles per rotor revolution.

U.S. Pat. No. 3,145,662, issued to Karl Eickmann on Aug. 25, 1964, discloses a rotary vane piston machine having fluid feed from the center of the rotor and radial passages within the rotor communicating between the rotor center and the compression chambers.

U.S. Pat. No. 3,932,063, issued to Denis Victor Butler on Jan. 13, 1976, exemplifies liquid ring pumps.

U.S. Pat. No. 4,578,948, issued to Allan I. Hutson et al. on Apr. 1, 1986, discloses a rotary vane pump having auxiliary pumping chambers provided by the slots holding the vanes. Valves are of the aligned port type. The housing cavity surface surrounding the rotor is round, as is the rotor body. At no point are the housing cavity surface and the rotor body outer surface parallel.

None of the above inventions and patents, taken either singly or in combination is seen to describe the instant invention as claimed.

SUMMARY AND OBJECTS OF THE INVENTION

The present invention provides a rotary vane pump having all fluid ports located radially beneath the expansible and retractable pumping chambers. Centrifugal action will hold a certain amount of fluid radially outwardly, thus providing the inlet suction effect of a liquid ring pump. Fluid moves radially outward during chamber expansion causing reduced pressure and suction action at the inlet ports, permitting the pumping chambers to be charged under conditions of very low pressure.

A novel feature is a revised stationary central member governing flow of fluid into and out of the pumping chamber, this member being referred to as a "liquid distributor". The novel liquid distributor is adapted to cause liquid flow to and from two pumping chambers simultaneously.

An exemplary application of the novel rotary vane pump is within the field of jet aircraft. Jet fuel is normally supplied by multistage pumps, each stage operating within certain pressure limits. The inlet pressure may become very low as the craft reaches high altitude, and the ability of ordinary pumps to cope with this pressure requires multistage pump operation. Although this approach works, it is very desirable to minimize size and weight in aircraft. Hence, a single stage pump accommodating low inlet pressure but yielding high discharge pressure would provide reduced aircraft weight and space requirements.

Modification of the pump casing and cylindrical pumping chamber enables separation of particulate matter from the fluid by the above described centrifugal action, whereby the particulate matter may be collected in a removable chamber. Normally the particulate matter will be heavier than the fluid such that the particulate matter will be urged by the centrifugal forced towards openings in the pumping chamber connected by passageways in the pump casing to the collecting chamber which may be removed from the pump casing for disposal of the particulate matter.

Accordingly a principle object of the present invention is to provide a rotary vane pump operable with low inlet pressure and providing high discharge pressure.

It is another object of the invention to provide a rotary vane pump wherein the vanes provide auxiliary pumping chambers.

It is a further object to provide a rotary vane pump having radially outward fluid inlet flow.

Still another object is to provide a rotary vane pump having inlet and discharge ports disposed between the pumping chambers and the rotor rotational axis.

It is still a further object to provide a rotary vane pump wherein each pumping chamber provides plural charge and discharge cycles in a single revolution of the pump rotor.

Yet another object is to provide a rotary vane pump operable with low inlet pressure, providing high discharge pressure, and being of reduced size, weight and complexity.

It is a still further object to provide a means for separating particulate matter from the fluid in a rotary vane pump.

With these and other objects in view which will more readily appear as the nature of the invention is better understood, the invention consists in the novel construction, combination and assembly of parts hereinafter more fully described, illustrated and claimed with reference being made to the attached drawings.

Figure 1:
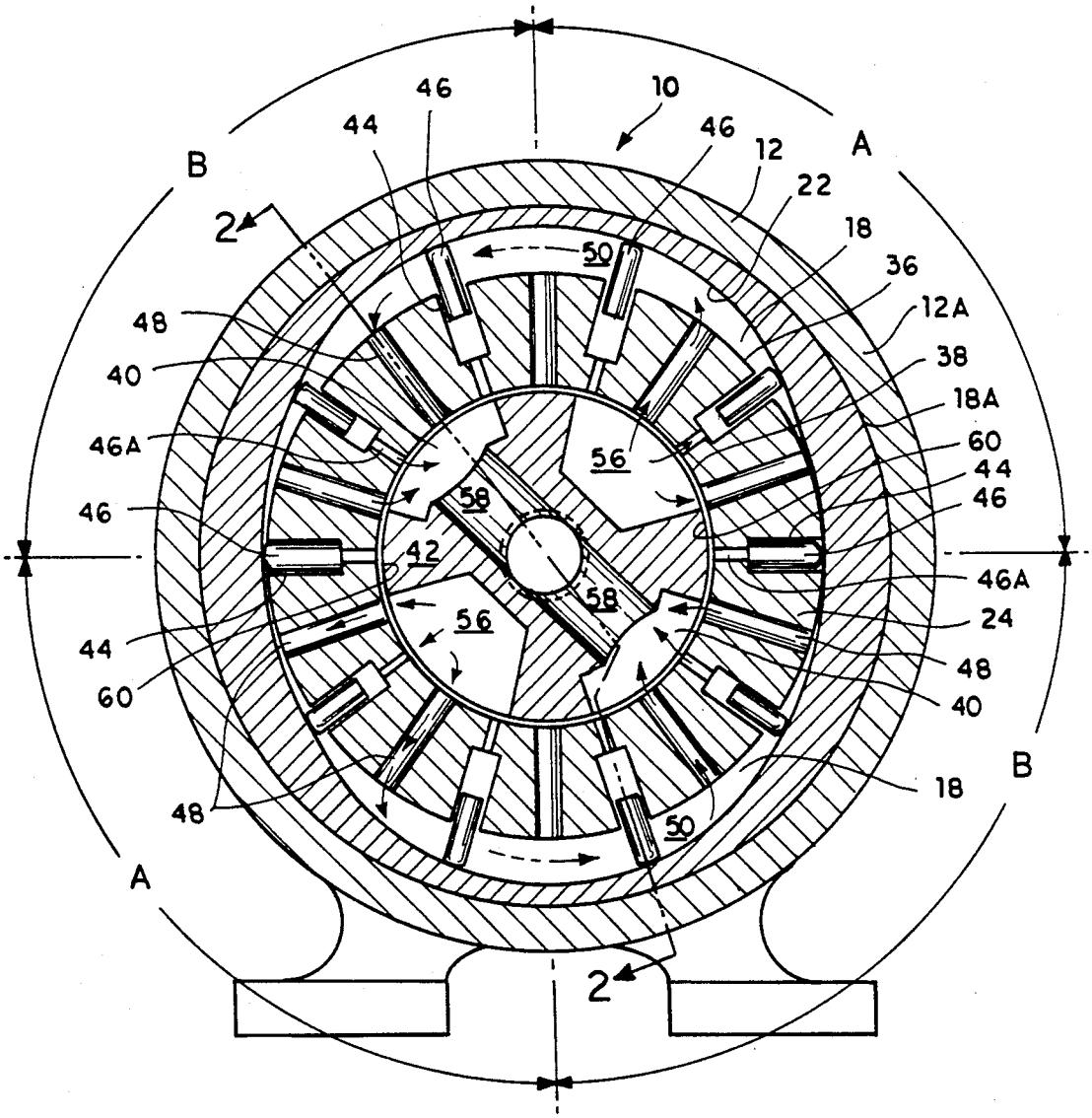
FIG. 1 is a sectional view taken along line 1—1 of FIG. 2.

Similarly reference characters denote corresponding features consistently throughout the attached drawings.

DETAILED DESCRIPTION OF THE PREFERRED EMBODIMENT

Figure 2:
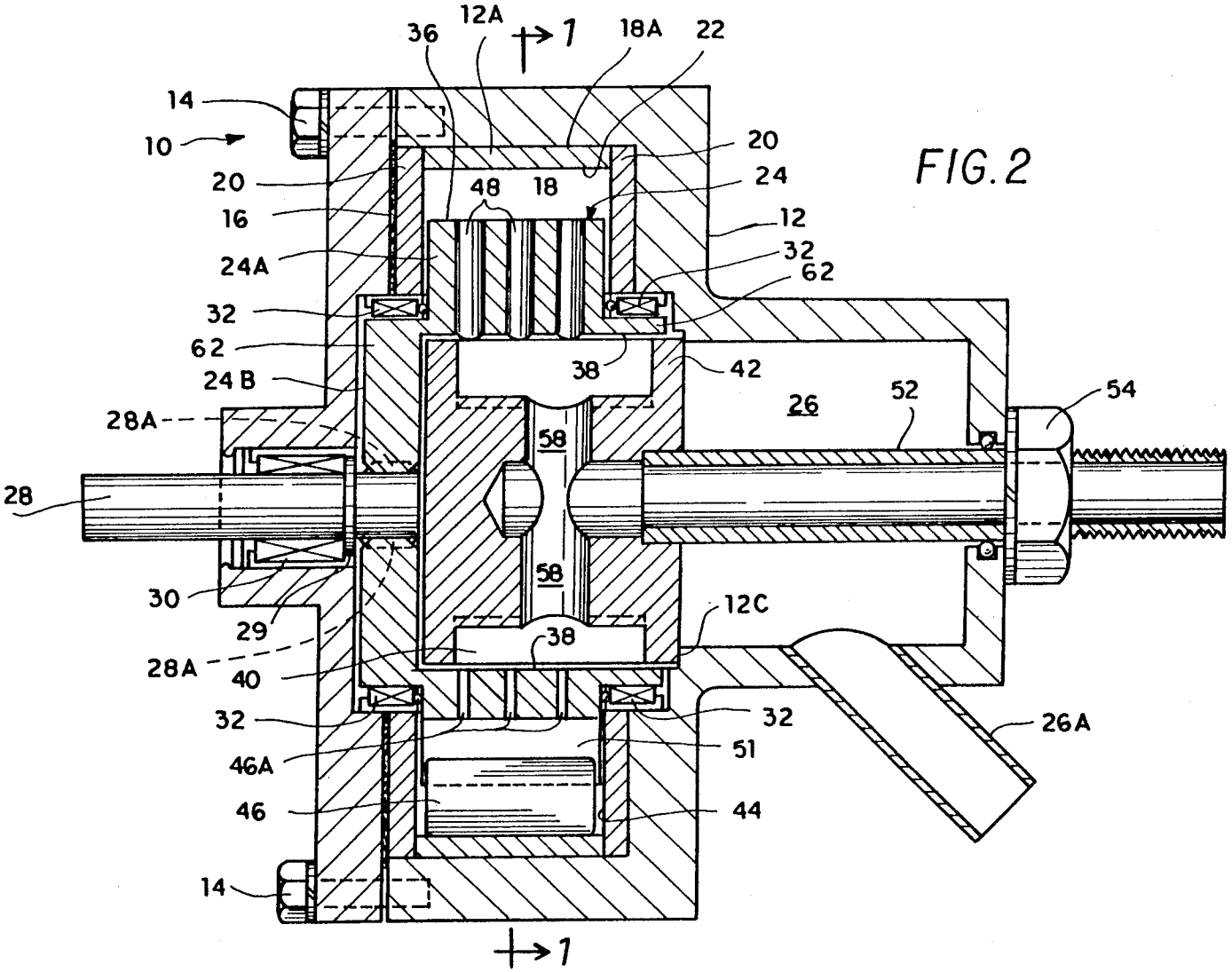
FIG. 2 is a sectional view taken along line 2—2 of FIG. 1.

General construction of the rotary vane pump 10 of the present invention is shown in FIG. 2. A pump casing 12 comprises a split housing as shown, securely joined by bolts 14 and sealed by a gasket 16. A pumping cavity 18 located within this casing 12 consists of an internally impressed cylindrical pumping chamber 12A having a round external surface 18A, an elliptically shaped internal rubbing surface 22 and end walls 20. A rotor 24 rotating within the pumping cavity 18 has a hollow, generally cylindrical ring 24A, and is capped at one end by an end plate 24B. The rotor 24 thus appears cup-like.

An inlet chamber 26 is also defined within the pump casing 12. An inlet conduit 26A leads into the inlet chamber 26.

A shaft 28, supported on shaft bearings 30 is connected by splines 28A to rotor end plate 24B, and serves to provide a rotational input, as by a motor (not shown). The rotor 24 is supported on rotor bearings 32, which rotor bearings support hub-like extensions 62 on each side of rotor 24. A flange 29 is mounted on shaft 28 which bears on bearings 30 to retain shaft 28 in position. Rotor bearings 32 also function as end bearings to counter axial thrust of rotor 24.

Figure 5:
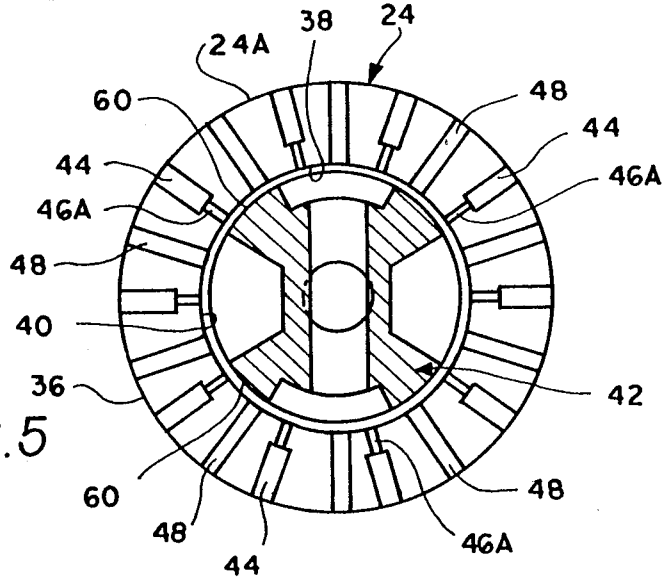
FIG. 5 is a sectional view of the rotor and liquid distributor of the present invention.
Figure 6:
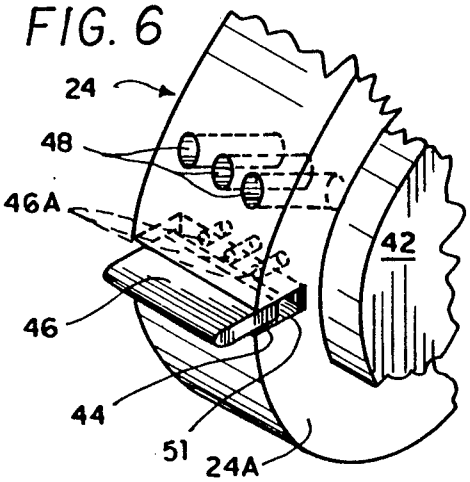
FIG. 6 is a partial perspective view of the rotor.

Seen better in FIG. 5, and with reference to FIG. 1, the rotor cylindrical ring 24A has outer and inner cylindrical surface 36, 38 (respectively). A cylindrical cavity 40 defined by the rotor inner cylindrical surface 38 surrounds a fluid distributor 42. The rotor 24 has slots 44 defined therein to hold slidable vanes 46. The rotor 24 also has passages 48 communicating between outer and inner surface 36, 38. Slots 44, vanes 46 and passages 48 are illustrated in FIG. 6, along with undervane passages 46A.

Shown more clearly in FIG. 1, pumping chambers 50 are defined between adjacent vanes 46, rotor outer surface 36, and the case inner surface 22 and end walls 20. These pumping chambers 50 vary in volume as the rotor 24 rotates, in a manner well known in the art, and as explained in U.S. Pat. No. 3,145,662 issued to Karl Eickmann, U.S. Pat. No. 3,932,063 issued to Denis Victor Bulter, and U.S. Pat. No. 4,578,948 issued to Allan I. Hutson et al., cited above. Fluid enters each pumping chamber 50 during expansion, as indicted at an expansion area A in FIG. 1.

When this pumping chamber 50 advances to a displacement area B of FIG. 1, the chamber volume decreases, and the fluid is expelled through passages 48 and undervane passages 46A. Of course, expansion and displacement are determined by rotational direction; in FIG. 1, rotation is indicated by arrows drawn with dashed lines. Inlet to and outlet from the pumping chambers 50 of fluid occurs only through passages 48.

Figure 3:
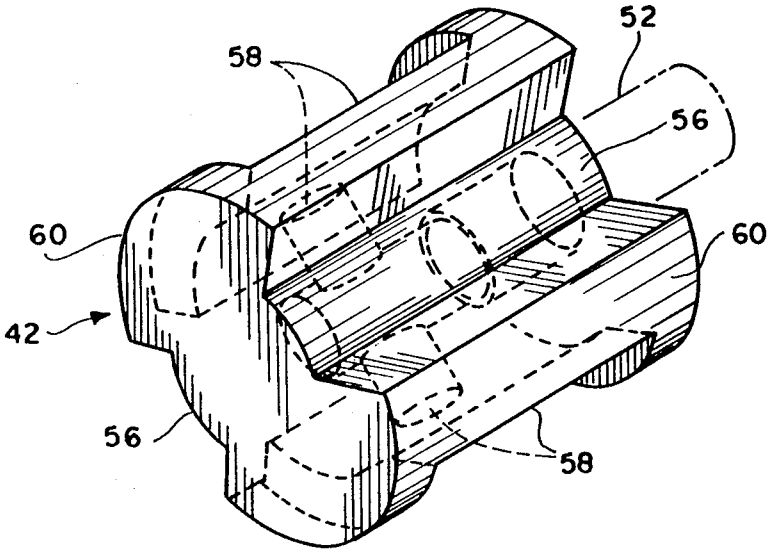
FIG. 3 is a perspective view of the liquid distributor.

The fluid distributer 42 is rigidly affixed to discharge conduit 52 as by a brazing operation or equivalent. Discharge conduit 52 is rigidly secured to the pump casing 12 by a locknut 54 which pulls the liquid distributor 42 tightly into contact with a shoulder 12C. Better seen in FIG. 3, the fluid distributor 42 is seen to have opposed inlet channels 56, and also outlet channels 58 which communicate directly with discharge conduit 52.

Auxiliary pumping chambers 51 are provided by slots 44 in the space existing beneath vanes 46 which vanes are free to slide radially. Orifices or undervane passages 46A communicate between the slots 44 and the rotor inner surface 38 so that fluid may flow into said and out from auxiliary pumping chambers 51. Fluid is thus taken from the distributor inlet channel 56, pressurized, and discharge to the distributor outlet channels 58, and pumping output is augmented.

Figure 4:
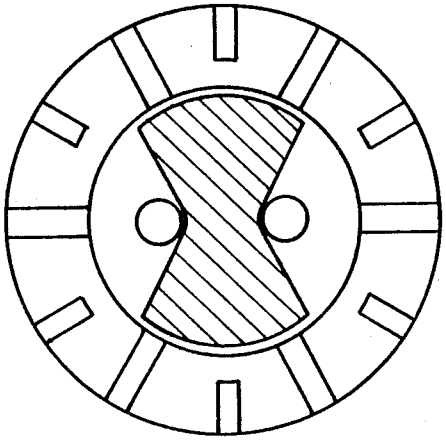
FIG. 4 PRIOR ART
FIG. 4 is a sectional view of a prior art pump showing the rotor and liquid distributing means.
Figure 7:
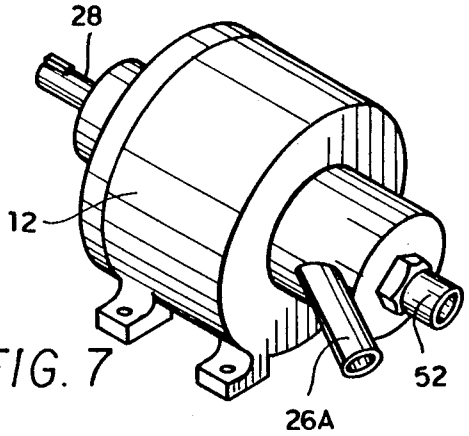
FIG. 7 is a perspective view of the present invention.

The fluid distributor 42 differs from the prior art shown in FIG. 4 in that the incoming fluid flows from an enlarged cavity 26 to generously sized distributor ports 56 symmetrically disposed about the centerline axis and thence into the pumping action of the rotor 24. Discharged fluid is collected symmetrically by discharge ports 58 which communicate with the central discharge conduit 52. This construction obviates conduits collecting discharged fluid from the periphery of the rotor, as shown in U.S. Pat. No. 1,104,070 issued to Overly, cited above, and permits the pump 10 to assume the compact configuration shown in FIG. 7, with inlet conduit 26A being proximate the discharge conduit 52, all the while providing two pumping chambers 50 undergoing pumping operation at one time. Although U.S. Pat. No. 3,145,662, issued to Eickmann discloses proximate inlet and outlet ports, as illustrated in FIG. 4, the Eickmann pump produces only one pumping cycle per pumping chamber per revolution.

Also, greatly enlarged inlet channels 56 (compared to inlet and outlet ports I, O, respectively of the prior art shown in FIG. 4) ensure that the fluid distributor 42 does not provide excessive restriction, and thus become a factor limiting fluid flow through the pump 10. Inlet channels 56 have a cross sectional area greater than the cross-sectional area of all rotor passages 48 and auxiliary pumping chamber orifices 46A which are admitting fluid to their respective chambers 50, 51 at any one point in time.

The fluid distributor 42 presents blocking surfaces 60 to obstruct passages 48 during phases of rotation when communication of any of the pumping chambers 50 with the inlet or outlet channels 56, 58 would be undesirable. As the rotor 24 rotates, the passages 48 are progressively open to the inlet channel 56; obstructed; open to the outlet channel 58; and obstructed. This cycle is repeated with further rotation.

Referring now to fluid flow, FIG. 2, fluid enters inlet chamber 26 through inlet conduit 26A, and then flows through inlet channels 56 in FIG. 1. (Again, rotor rotation is counterclockwise in the sense of FIG. 1 and as indicated by the dashed arrows in the figure.) As indicated in FIG. 1 by solids arrows, fluid flows from inlet channels 56 to passage 48. Under the influence of inlet pressure and urged by centrifugal force, fluid enters an expanding pumping chamber 50. Incoming fluid is slug by centrifugal force to the outermost portion of the pumping chamber 50. A liquid ring partially sealing the pumping chamber 50 where the vanes 46 meet the pump case inner surface 22 is thus provided.

The fluid is trapped within any pumping chamber 50 upon obstruction of the passages 48 by rotor rotation, and is displaced upon pumping chamber contraction. As a pumping chamber 50 passes the blocking surface 60, which is coincident with pumping chamber contraction, the passages 48 communicate with the outlet channel 58. Displaced fluid now flows out through the passages 48, through the outlet channel 58, and into the discharge conduit 52.

The pumping cavity 18 is seen to have two pumping areas B, B, located 180 degrees apart with respect to rotor rotational axis volume and two expansion areas A, A.

Not all the fluid originally contained in a pumping chamber 50 is discharged upon pumping chamber contraction. This residual fluid is transported within the pumping chamber 50 until the expansion phase of the next cycle commences. Another way of looking at this is that at any point in time, two opposed pumping chambers 50 are operating simultaneously, each of the two undergoing the sample phase in an entire pumping cycle as the other.

The liquid distributor 42 accordingly has two inlet channels 56 and two outlet channels 58. Thus, a single inlet chamber 26 and a single discharge conduit 52 are manifolded to serve two pumping chambers 50 simultaneously, increasing the output of the pump 10 for each rotor revolution.

It should be noted that by reversing the flow of fluid, that is, by making elements 56 opposed inlet channels and elements 58 opposed outlet channels, the rotation of rotor 24 would be reversed, and pump 10 would become a hydraulic motor.

Figure 8:
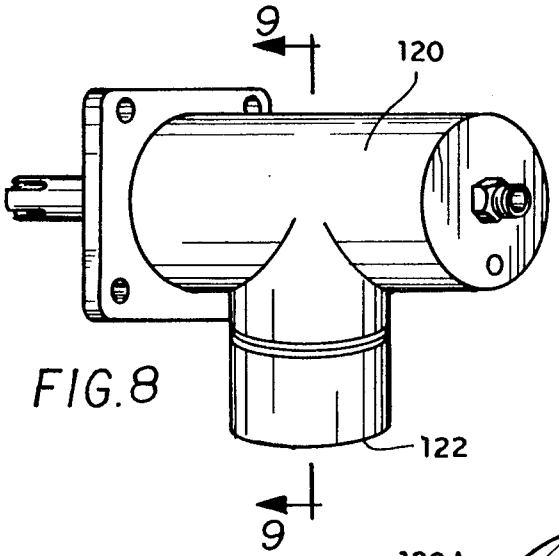
FIG. 8 is a perspective view of the pump casing modified to include a removable particulate collecting chamber.
Figure 9:
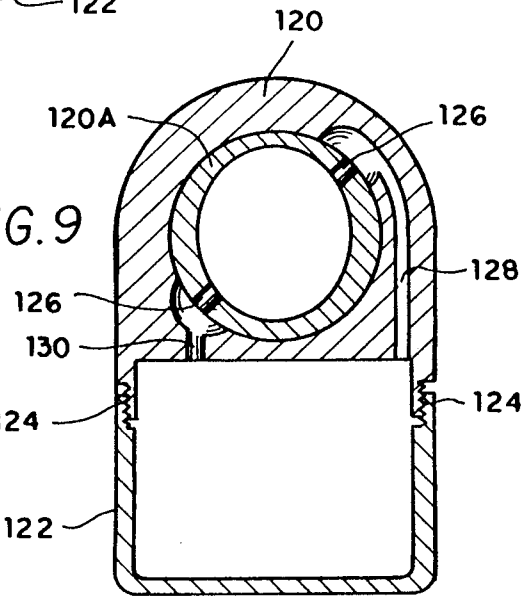
FIG. 9 is a cross sectional view taken along line 9—9 of FIG. 8 showing the openings in the pumping chamber and passageways leading to the removable particulate collecting chamber.
Figure 10:
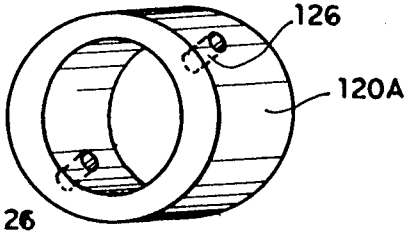
FIG. 10 is a perspective view of the pumping chamber showing the openings in the boundary wall thereof for passage of the particulate material.

FIGS. 8, 9 and 10 disclose a modification of the rotary pump casing 12 and the cylindrical pumping chamber 12A. Rotary pump casing 120 shown in FIGS. 8 and 9 has removably attached thereto a removable particulate collecting chamber 122, as by means of a threaded connection 124. Casing 120 contains pumping chamber 120A with its boundary walls including openings 126 located in the low pressure expansion areas A, A shown in FIG. 1. Openings 126 communicate with passageways 128, 130 in pump casing 120 which enable particulate matter separated by centrifugal force to travel to removable particulate chamber 122.

While the openings 126 and passageways 128 and 130 have been shown to be located in the low pressure expansion areas A and A', these openings and passageways may alternatively be placed in the higher pressure pumping areas B, B, if found to be desirable.

It is to be understood that the present invention is not limited to the embodiments described above, but encompasses any and all embodiments with the scope of the following claims.

I claim:

1. In a rotary pump having at least one expansion area and at least one displacement area for pumping liquids said pump including a boundary wall enclosed within a pump casing, a particulate separation means comprising:

a removable particulate collection chamber connected to said pump casing;

an opening in said boundary wall located in said expansion area; and a passageway in said pump casing connecting said opening with said removable particulate collection chamber; whereby particulate material separated from said liquids by centrifugal force may be collected in said removable particulate collection chamber for subsequent disposal.

* * * * *